United States Patent [19]

Hikosaka et al.

[11] 4,058,092

[45] Nov. 15, 1977

[54] V-TYPE ENGINES

[75] Inventors: Noboru Hikosaka, Kamakura; Mitsuo Watanabe, Yokohama; Shoji Shiozaki, Fujisawa, all of Japan

[73] Assignee: Isuzu Motors Limited, Tokyo, Japan

[21] Appl. No.: 635,518

[22] Filed: Nov. 26, 1975

[30] Foreign Application Priority Data

Nov. 27, 1974 Japan ..... 49-136460

[51] Int. Cl.[2] ..... F02B 3/00; F02B 75/22

[52] U.S. Cl. ..... 123/32 ST; 123/52 MV; 123/55 VE; 123/191 M

[58] Field of Search ..... 123/32 C, 32 D, 32 K, 123/32 ST, 32 SP, 52 MV, 55 R, 55 VE, 75 B, 188 M, 193 H, 191 M

[56] References Cited

U.S. PATENT DOCUMENTS

| | | | |
|---|---|---|---|
| 2,687,714 | 8/1954 | Flatz et al. | 123/193 H |
| 2.772,668 | 12/1956 | Nystrom et al. | 123/52 MV |
| 2,856,909 | 10/1958 | Turlay | 123/191 M |
| 2,957,460 | 10/1960 | Kolbe | 123/55 VE |
| 2,963,006 | 12/1960 | Karde | 123/32 D |
| 3,154,059 | 10/1964 | Witzky et al. | 123/188 M |
| 3,963,003 | 6/1976 | Downs | 123/32 K |

FOREIGN PATENT DOCUMENTS

| | | | |
|---|---|---|---|
| 1,173,287 | 7/1964 | Germany | 123/32 C |
| 851,433 | 10/1960 | United Kingdom | 123/55 R |

*Primary Examiner*—Ronald H. Lazarus
*Assistant Examiner*—Craig R. Feinberg
*Attorney, Agent, or Firm*—Sughrue, Rothwell, Mion, Zinn and Macpeak

[57] ABSTRACT

A compact V-type internal combustion engine which has two banks arranged in a V-shaped form having its bore pitch-to-bore diameter ratio no more than 1.25. The V-type engine includes auxiliary combustion chambers, an injection pump located inside the V-shape, injection nozzles each projecting into the bank from the inside of the V-shape, intake manifolds each connected to the bank from the inside thereof, exhaust manifolds each connected to the bank from the outside thereof, injection pipes each connected between the injection pump and the injection nozzle. The auxiliary combustion chamber is disposed above the cylinder and on a transverse line extending through the center of the cylinder. The injection nozzle is disposed on a plane made by the transverse line and an axis of the cylinder and inclinded at an angle with the cylinder axis. A common cam shaft is provided for operating valve—mechanisms for the respective banks on which cams for one bank and cams for the other bank are alternatively arranged in order to enlarge the space between the push rods.

4 Claims, 7 Drawing Figures

V-TYPE ENGINES

BACKGROUND OF THE INVENTION

1. Field of the Invention

This invention relates to a compact V-type internal combustion engine in which two banks are arranged in a V-shaped form and more particularly, to an improved arrangement of a V-type engine equipped with an auxiliary combustion chamber and with a common cam shaft for operating the valve operating mechanisms.

2. Description of the Prior Art

V-type internal combustion engines have been proposed in the prior art in which a left bank and a right bank are arranged in a V-shaped form. A typical arrangement of such V-type engines, as shown in FIG. 3*a*, comprises an injection pump (A) located inside the V-shaped between the two banks, injection nozzles (B) each projecting into the bank from the outside of the V-shape, intake manifolds (C) each connected to the bank from the inside thereof, exhaust manifolds (D) each connected to the bank from the outside thereof, a cam shaft (E), a crank shaft (F), and injection pipes (G) each connected between the injection pump and the injection nozzle. However, such V-type engines having the injection pump and the injection nozzle located at the opposite positions with respect to the bank require an elongated injection pipe for connection. This causes unfavorable fuel injection characteristics from the view point of exhaust smoke, gaseous emissions and performance.

In order to shorten the injection pipe, several different arrangements have also been proposed in the prior art. One such arrangement has the intake manifolds connected from a position outside of the V-shape and on the same side as the exhaust manifold to provide a space for projecting the injection nozzles to the banks from the inside thereof so as to locate the nozzles close to the injection pump (see FIG. 3*b*). However, this arrangement spoils the volumetric efficiency and output power and increases the width of the engine. Another arrangement has two cam shafts disposed outside the banks instead of a single cam shaft disposed inside the banks (see FIG. 3*c*). This increases the number of the structural parts and, in turn, increases the weight and cost of the engine. A further arrangement, which has two separated pumps disposed outside of the V-shape and close to the respective injection nozzles, also increases the weight and cost of the engine (see FIG. 3*d*). Accordingly the prior art arrangements do not provide optimum performance of the engines within the limited conditions such as size, weight, cost or the like.

SUMMARY OF THE INVENTION

The present invention provides a V-type internal combustion engine of the type having auxiliary combustion chambers and comprising two banks arranged in a V-shaped form, an injection pump located inside the V-shape between the two banks, injection nozzles projecting into respective auxiliary combustion chambers from the inside the V-shape between the two banks, a cross flow type cylinder head with intake ports opening on the inside of the V-shape, intake manifolds each connected to the bank from the inside of the V-shape, exhaust manifolds each connected to the bank from the outside of the V-shape, a common cam shaft, a crank shaft, and injection pipes each connected between the injection pump and the injection nozzle (see FIG. 3*e*).

In accordance with the present invention, the engines can be designed so as to have their bore pitch-to-bore diameter ratios, which are used to show the engines having reduced size and weight, no more than 1.25. The ratio is obtained by dividing the distance between centers of adjacent bores by the diameter of the bores. It has been considered very difficult, if not impossible, to design a V-type internal combustion engine with precombustion chamber.

It is a main object of the present invention to provide a V-type internal combustion engine which will be free from the above-mentioned and other disadvantages of the prior art engines and which will be a low cost, light weight, compact and high performance engine.

Another object of the present invention is to provide an improved overhead valve type and V-type internal combustion engine which is condusive to superior engine performance.

A further object of the present invention is to provide an improved injection type internal combustion engine having an auxiliary combustion chamber disposed within the cylinder head. This provides the best layout for designing the internal combustion engine.

A still further object of the present invention is to provide an improved arrangement of auxiliary combustion chamber, injection nozzles, cylinder head bolts, push rods, intake and exhaust valves, intake and exhaust ports and the like which is suitable for V-type engines, thereby reducing the size and weight of the engines.

BRIEF DESCRIPTION OF THE DRAWINGS

The present invention will be more fully understood and its objects and advantages further appreciated by referring to the following detailed specification taken in conjunction with the drawings in which.

DETAILED DESCRIPTION OF THE INVENTION

Figure 1:
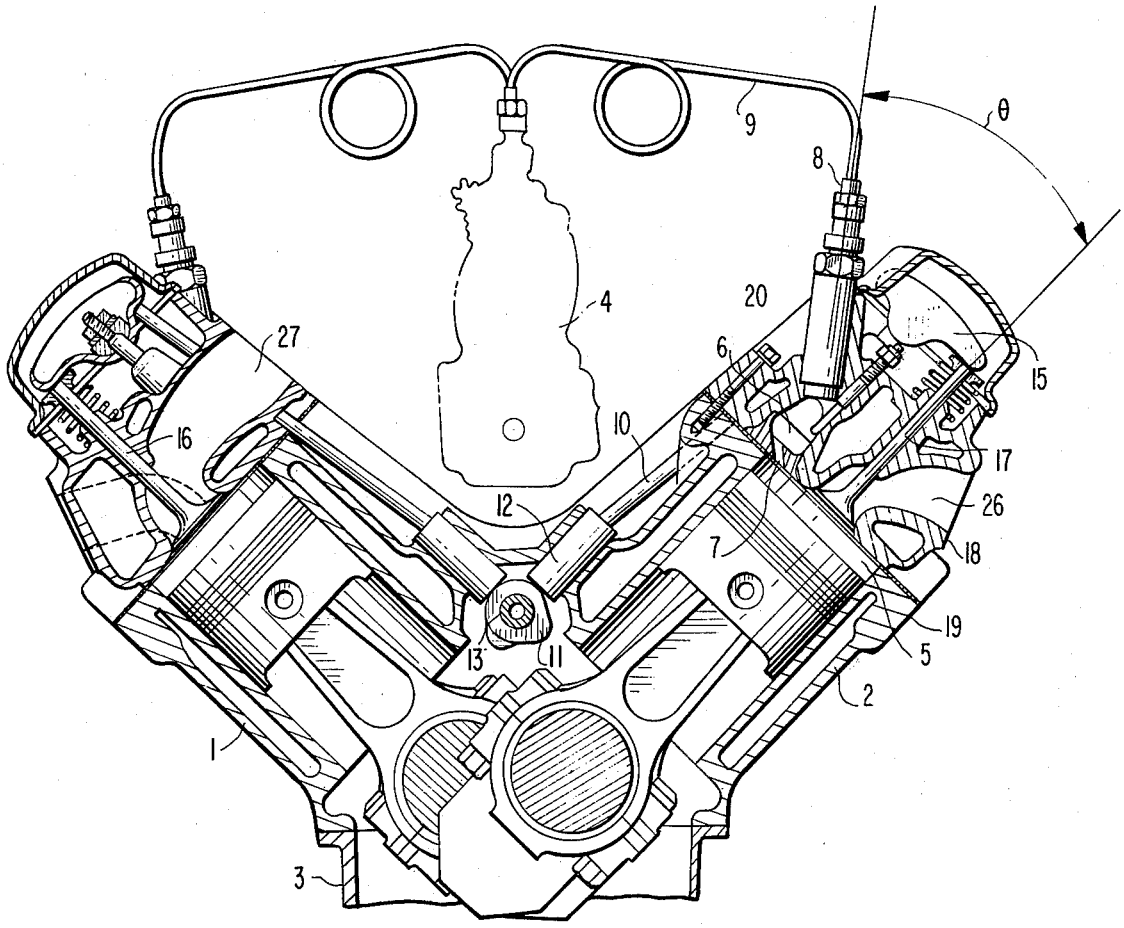
FIG. 1 is an elevational view in section of a V-type internal combustion engine according to this invention.
Figure 2:
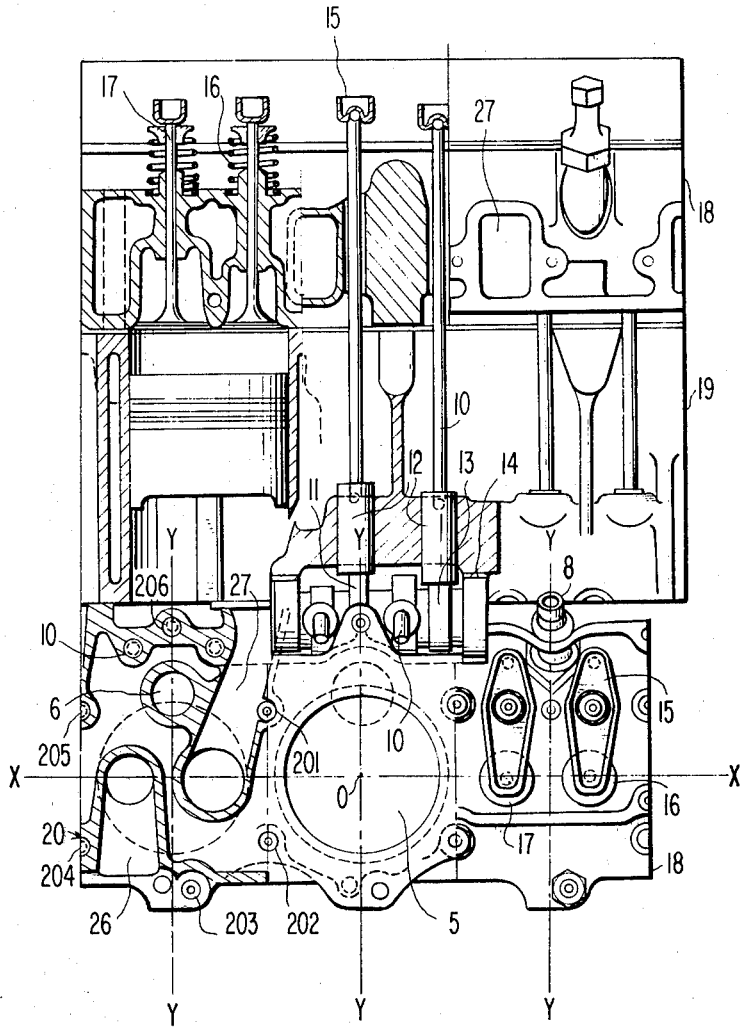
FIG. 2 is an perspective view in section of the V-type engine of FIG. 1.
Figure 3A:
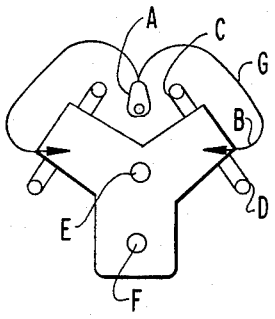
FIG 3a PRIOR ART
FIGS. 3*a* through 3*d* are schematic representations showing the prior art arrangement of V-type engines.
Figure 3B:
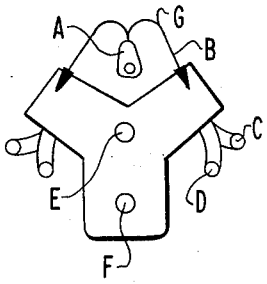
FIG 3b PRIOR ART
Figure 3C:
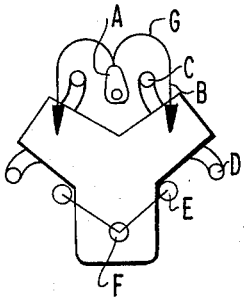
FIG 3c PRIOR ART
Figure 3D:
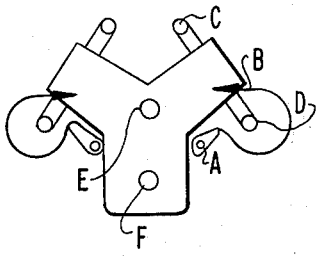
FIG 3d PRIOR ART
Figure 3E:
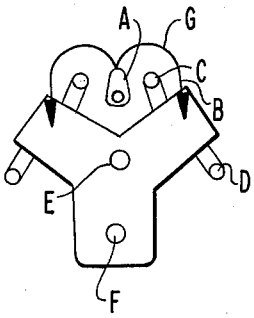
FIG. 3*e* is a schematic representation showing the arrangement of the engine according to this invention.

Referring now to the drawings, FIGS. 1 and 2 illustrate a V-type internal combustion engine according to this invention which comprises a left bank 1 and a right bank 2 arranged in a V-shaped form, an injection pump 4 located inside the V-shape between the two banks 1 and 2, cross flow type cylinder head with intake ports opening on inside of V-shape intake manifolds each connected to the bank from the inside of the V-shape, exhaust manifolds each connected to the bank from the outside thereof, a crank shaft, and a common cam shaft 13 disposed directly above the crank shaft for operating valve mechanisms of the left and right banks.

In FIG. 2, the line X—X indicates a longitudinal line extending longitudinally of the engine through the center O of the cylinder 5, and the lines Y—Y indicate first transverse lines for each cylinder extending perpendicularly to the second traverse line X—X through the center O of all cylinders in a given bank.

An auxiliary combustion chamber or precombustion chamber 6 such as a swirl chamber is disposed in the vicinity of the inner side of the V-shape above the cylinder 5 in such a way that its center is laid on the transverse line Y—Y. The auxiliary combustion chamber 6 is communicated through a throat 7 with the cylinder 5. Projecting from the inside of the V-shape into the auxiliary chamber 6 is an injection nozzle 8 disposed on a plane made by the transverse line Y—Y and the cylinder axis and inclined at an angle in the range of 0° to 60° with the cylinder axis. The injection nozzle 8 is connected through a injection pipe 9 to the injection pump 4. This arrangement in which the injection nozzle 8 is disposed on the same side of the bank as the injection pump permits the application of a shortened injection pipe.

A valve mechanism is disposed along the innermost side and comprises a common cam shaft 13 supported by bearings 14, cams 11 secured to the cam shaft 13, tappets 12 whose bottoms are in contact with the cams 11, push rods 10 connected to the tappets 12, and rocker arms 15 connected to the push rods 10 and connected to an intake valve 16 and an exhaust valve 17 for opening and closing the valves, respectively. The tappets 12 for the left bank and the tappets 12 for the right bank are alternatively arranged as well as the cams 11 and the push rods 10, and the rocker arms are arranged parallel and symmetrically with respect to the transverse line X—Y. This arrangement permits the provision of a compact valve mechanism and the enlargements of the spaces between the push rods and between the tappets.

A cylinder head 18 is attached to a cylinder body 19 by means of six cylinder bolts 201 to 206. The bolts 201 to 205 except for the bolt 206 are disposed at the same distance from the center of the cylinder 5. The bolts 201 and 202 and the bolts 204 and 205 are disposed symmetrically with respect to the longitudinal line X—X and the bolts 201 and 205 and the bolts 202 and 204 are disposed symmetrically with respect to the transverse line Y—Y. The bolt 206 is disposed on the transverse line Y—Y and at the back of the auxiliary combustion chamber 6. Accordingly, the bolts 201 to 206 are arranged substantially in a hexagonal form. This arrangement permits the provision of preferably balanced attachment between the cylinder head and the cylinder body.

An exhaust port 26 extends between the head bolts 203 and 204 and opens toward the outside of the V-shape. An intake port 27 extends among the push rods 10, the auxiliary combustion chamber 6, and the head bolt 201 and opens toward the inside of the V-shape. The head bolt 201 may be partially exposed to the intake port 27 in order to enlarge the space of the intake port as large as possible. The cylinder head for the left bank and that for the right bank are identical in arrangement.

In accordance with the above-described arrangement of this invention, a V-type internal combustion engine with auxiliary combustion chambers having its bore pitch-to-bore diameter ratio no more than 1.25 can be provided.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A V-type internal combustion engine of the type having a plurality of pistons and piston cylinders positioned in left and right banks, respectively, which are inclined with respect to one another to form a V-shape, the space between said banks being defined as within said V-shape, said engine further having a cross flow cylinder head with intake ports opening within said V-shape, exhaust ports in said banks opening to the space outside said V-shape, an injection pump disposed within said V-shape, a cam shaft at the apex of said V-shape, said engine comprising; auxiliary combustion chambers, one for each piston, disposed in said right and left banks in the vicinity of the inner side of the V-shape above said piston cylinders, respectively, and a plurality of throats for providing communication between said respective cylinders and auxiliary combustion chambers, each said auxiliary chamber being positioned along a first transverse line passing thru the center of the respective cylinder, which transverse line is perpendicular to a second transverse line passing through the centers of all cylinders in a given bank, said first and second transverse line defining a plane substantially parallel with the top and bottom surface of said cylinders in a given bank; injection nozzles for each auxiliary combustion chamber respectively, each having its axis disposed in a plane defined by said first transverse line and the axis of a respective cylinder, and inclined at an angle between 0° and 60° with respect to said cylinder axis and having one end projecting into said respective auxiliary combustion chamber and the other end being within said V-shape;

and further comprising for each cylinder, an intake valve and an exhaust valve, a pair of rocker arms disposed symmetrically about said first traverse line and said auxiliary combustion chamber and above said cylinder and valves, one end of said pair of rockers operatively connected to said intake and exhaust valves, respectively, a pair of push rods operatively engaged at one end thereof to the other ends of said rocker arms, respectively, a pair of cams on said cam shaft for operatively engaging the other ends of said push rods, respectively, the said cams for all said cylinders being arranged on said shaft so that adjacent cams engage push rods existing in opposite banks.

2. A V-type internal combustion engine as claimed in claim 1 wherein said engine includes a cylinder head bolted to each cylinder by six cylinder head bolts one of said bolts being positioned in a location nearest to the inner side of the V-shape.

3. A V-type internal combustion engine as set forth in claim 2, wherein for each cylinder the remaining five of said bolts are disposed at the same distance from the axis center of said cylinder and four of said five bolts are disposed symmetrically with respect to said first transverse line and said second transverse line.

4. A V-type internal combustion engine as set forth in claim 3, wherein the intake port for each cylinder extends to one side of the push rods and the auxiliary combustion chamber for said cylinder, the exhaust port for said cylinder extends between the bolt disposed at the outermost of the V-shape and the bolt next adjacent thereto wherein one of said bolts is at least partially exposed in said intake port and wherein said engine has a bore pitch-to-bore diameter ratio no more than 1.25.

* * * * *